United States Patent [19]

Weir

[11] 3,994,485

[45] Nov. 30, 1976

[54] METHOD AND APPARATUS FOR SHEET FOLDING

[76] Inventor: Henry John Weir, 'Alta Vista, Knapton Road, Monkstown, County Dublin, Ireland

[22] Filed: Apr. 29, 1975

[21] Appl. No.: 572,665

[30] Foreign Application Priority Data

May 13, 1974 Ireland ..... 1006/74

[52] U.S. Cl. ..... 270/61 R; 270/30; 223/37

[51] Int. Cl.[2] ..... B65H 45/00

[58] Field of Search ..... 223/37, 28; 270/30–31, 270/61 R, 62, 79; 38/104, 108, 143

[56] References Cited

UNITED STATES PATENTS

| | | | |
|---|---|---|---|
| 149,015 | 3/1874 | Warth | 270/31 |
| 330,707 | 11/1885 | Irving | 270/61 R |
| 2,567,385 | 9/1951 | Lighter | 223/37 |
| 3,802,609 | 4/1974 | Benedetto | 223/37 |

*Primary Examiner*—Edgar S. Burr
*Assistant Examiner*—A. Heinz
*Attorney, Agent, or Firm*—Wallenstein, Spangenberg, Hattis & Strampel

[57] ABSTRACT

A method of folding laundry sheets and like articles is provided wherein a single operator drapes one edge across a carriage which is made to retreat from the operator while the latter locates the opposite sheet edge, causes the carriage to return, and drapes said opposite edge over the carriage similarly, repeating the process with the partially folded sheet until a complete set of primary or parallel folds is effected. The sheet is then optionally cross-folded once over a bar which can be removed bearing the thus draped sheet for removal from the bar and manual completion of folding. Apparatus provided for use in the process comprises a horizontally reciprocable carriage capable of retaining a sheet draped thereover, with appropriate drive and control means, and an optional cross-folding bar pivotable down upon the carriage after primary folding, and pivotable away and aside from the carriage with the primary folded sheet folded once across said bar.

20 Claims, 6 Drawing Figures

METHOD AND APPARATUS FOR SHEET FOLDING

This invention relates to a method and apparatus for folding substantially rectangular sheets of woven or non-woven fabric such as bed-sheets, blankets, bedcovers, tablecloths and the like, all hereinafter generally designated sheets, for transport and storage after laundering.

Modern clothes-washing and spin- and tumble-drying machinery has made substantial contributions to the management of the linen store in establishments such as hospitals, nursing homes, hotels, guest houses and schools, all but the smallest of which can nowadays handle most of their own laundry work, especially since the introduction of non-iron fabrics. Folding the laundered items for transport and storage, however, remains a labour-intensive operation for which little or no cheap and effective labour-saving apparatus has been proposed. Complex and bulky sheet-folding machinery is known. Examples have been published in British Patent Specification Nos. 837,215, 886,044, 1,016,692, 1,083,101, 1,277,241 and in U.S. Pat. Nos. 1,607,407, 1,766,789, 2,709,585, 2,759,762, 2,834,595, 2,858,129, 2,940,751, 2,969,233, 3,113,772, 3,154,726, 3,162,765, 3,190,640 and 3,212,771. The kind of machinery described in the above publications is, however, too expensive for acquisition and use by any but the largest establishments, apart from commercial laundries.

Manual sheet-folding is normally carried out by two persons, who grasp opposite edges of the sheet, shake the sheet out, and then approach each other with raised hands while the mid-section of the sheet falls into a loop between them. One person retains the two thus approximated edges while the other grasps the new "edge" represented by the loop and repeats the process. When a sufficient number of parallel folds (longitudinal or primary folds) have been made in the sheet the primary folded sheet is first rotated in its own plane through a right angle, and then the folding steps are repeated to produce the cross folds. The folded sheet is by now so reduced in extent that a single person can make the last couple of folds unaided.

It is an object of the present invention to partially mechanise the known process of manual sheet-folding by providing a mechanical substitute for one of the coventional two operators. It is another object of the invention to provide simple and relatively inexpensive apparatus for sheet folding which can be purchased for and used in hospitals, hotels, schools etc. for an outlay and space requirement which will be acceptable in such establishments.

The invention accordingly provides a one-operator method for folding a sheet having a pair of opposite edges, identified as the leading edge and the trailing edge, which method comprises a. symmetrically draping the leading edge over a retaining carriage which is horizontally movable away from and towards the operator in his line of sight ahead, the draping being perpendicular to said line of sight;
b. moving the thus draped retaining carriage (forward) away from the operator and holding it against return while the operator locates and holds the trailing edge;
c. moving the retaining carriage back to its initial position;

d. symmetrically draping the trailing edge over the leading edge upon the retaining carriage; and
e. repeating steps *b* to *d* *n* times according to need, treating each successive resulting creased or folded edge as the trailing edge for that purpose, where *n* is zero on an integer not exceeding 3.

In the above recitation "symmetrically" is to be understood as meaning that a mid-portion of the relevant sheet edge, as judged by the eye of the operator, is laid across the retaining carriage so that the lateral portions of said sheet edge, which hang downwardly on either side of the retaining carriage, are of substantially equal length. It will be clear therefore that the retaining carriage is preferably a platform located at a convenient working height, and that its width (transversely of the operator's line of sight ahead) is chosen so as to keep the lateral edges of the sheet substantially clear of the floor during folding, this avoiding any friction which might otherwise interfere with the neatness of the draping.

The term "retaining carriage" is employed to designate a structure, preferably a platform, which is adapted to detachable attachment of the sheet material thereto, preferably by simply pressing said material down thereupon, and pulling it away afterwards. The strength of the attachment should be sufficient to retain the sheet by its leading edge while the retaining carriage recedes from the operator. A platform having a surface which includes an area of grip-faced fabric or composition or of bristle matting is acceptable as the retaining carriage. A preferred material for this purpose is polyurethane foam sheeting, which grips most textile fabrics. Clips or clasps, preferably a single clip or clasp, which are or is capable of quick application and removal, may be used on the rear edge of the platform as an alternative to grip-faced fabric or the like.

The invention also provides apparatus for use in folding a sheet, which apparatus comprises a stand or support having a sheet material retaining carriage mounted thereon for substantially horizontal travel in either direction along a single rectilinear axis, the width of the carriage being substantially less than the width of a sheet to be folded. The single rectilinear axis is conveniently the longitudinal axis of the stand or support. The sheet material retaining carriage is preferably a platform having a surface which retains the sheet material placed thereupon either by simple friction or by means of bristle matting, clips or clasps.

The sheet material retaining carriage may be mounted on the stand or support by means of, for example, a rail or a pair of rails and a cooperating set of wheels, rollers or low-friction gliders. The said carriage may be moved by means of a drive belt or belts attached thereto and encircling a set of cooperating pulleys mounted on the stand or support, in the manner of a reverse-action block and tackle. Alternatively the carriage may be moved by means of a chain or chains encircling cooperating sprockets. As a further alternative, the carriage may be moved by a manual or pedal impulse in both directions, or in one direction against the resistance of a restoring spring, and in the reverse direction by the restoring spring, a releasable catch being provided to retain the carriage in one of its extreme positions.

The retaining carriage may be driven by a preferably reversible electric motor or by a manually or pedally operated system of levers and/or cranks, or it may be driven by pneumatic or hydraulic means, preferably through the medium of a drive belt or chain as recited above. Pneumatic operation, using a pneumatic cylinder, is especially preferred.

The apparatus of the invention preferably incorporates a bar pivotally mounted thereon which can be pivoted to remove it from the scene of operations during primary folding, and then pivoted into contact with the primary folded sheet transversely of the same. This allows one side of the primary folded sheet to be manually thrown across the bar to meet and match the other side of the sheet, thus providing the first cross-fold. The bar can then be pivoted upwardly and away from the carriage, carrying the sheet with it. It is a simple matter for the single operator to centre the cross-fold by matching the hanging ends of the sheet prior to sliding the sheet off the free end of the bar and completing the cross-folding manually.

The invention will be clearly understood from the following description of a specific and preferred embodiment thereof, given by way of example only, with reference to the accompanying drawings in which FIG. 1 is a perspective view of a sheet folding apparatus.

Figure 1:
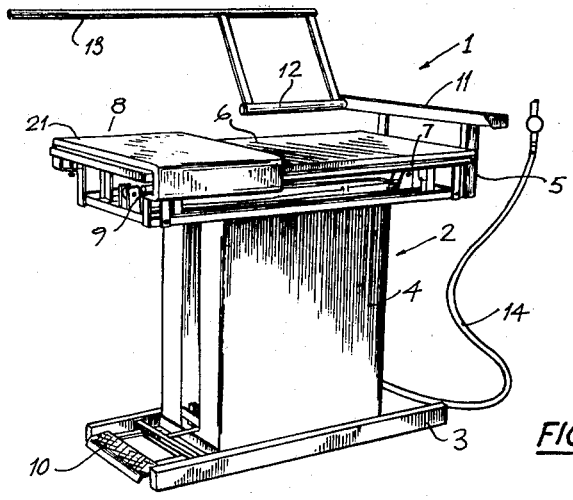
Figure 2:
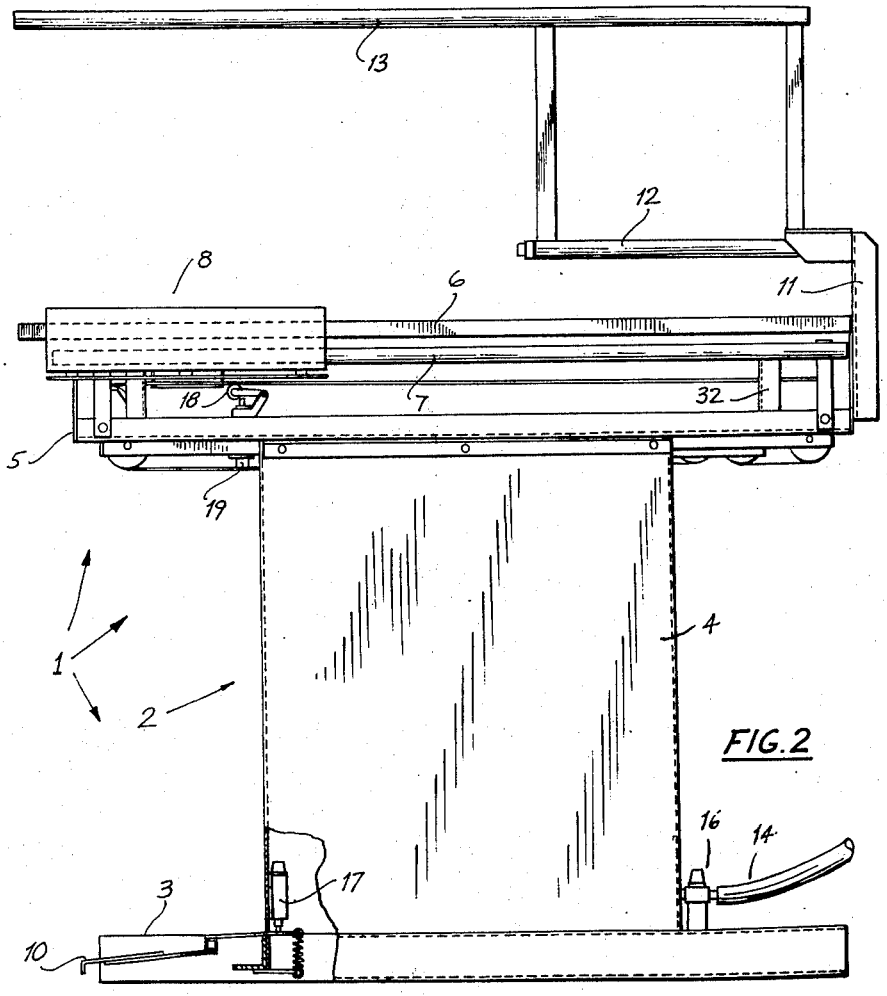
FIG. 2 is a side elevation of the apparatus of FIG. 1.
Figure 4:
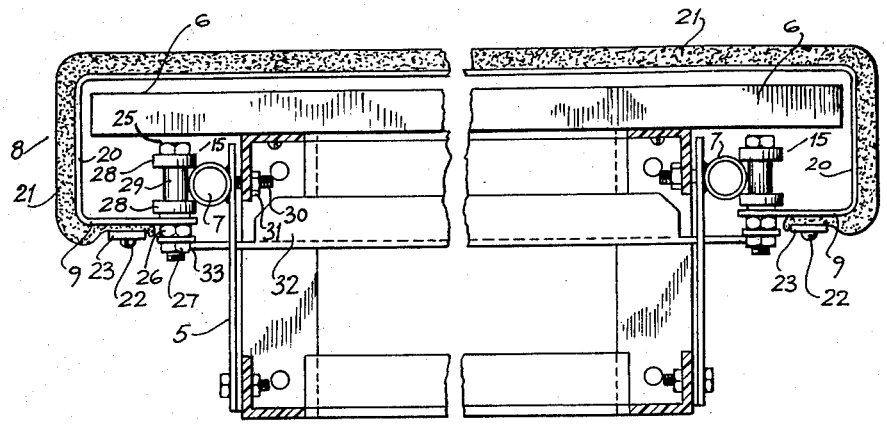
FIG. 4 is a front end elevation of the retaining carriage of the apparatus of FIGS. 1–3.

Referring now to the drawings, a sheet folding apparatus 1 comprises a stand 2 having a base 3, a stem 4 and a top framework 5 which includes a tabletop 6. The top framework 5 bears a pair of tubular rails 7, one on either side of the tabletop 6. A carriage 8 is mounted to run along the track provided by the pair of rails 7, by means of roller guides 15 fixed to the inwardly directed flanges 9 of the carriage 8 which is of C-shaped cross-section. The normal or resting position of the carriage 8 is the front position nearest to the operator in use, as shown in FIGS. 1 and 2, where the carriage 8 remains until manually displaced. A small manual forward displacement of the carriage 8 releases a cam lever 18, which sets the drive machinery in motion to bring the carriage 8 back to its alternative station at the other or rear end of the tabletop 6. A pedal 10 on being depressed actuates drive machinery (not shown) to bring the carriage 8 once again into its normal or resting position nearest to the operator.

An extension 11 of the top framework 5 carries journalled thereon a pivot shaft 12 which in turn carries a cross-folding rod 13. When required the rod 13 can be pivoted downwardly in the direction of the arrow to lie at 13*a*, (see FIG. 3) along the centreline of the upper surface of the carriage 8. A hose 14 provides a connection between a compressed air source (not shown) and the drive machinery via a connecting nipple 16 and a pneumatic circuit (not shown). Thus the drive machinery is pneumatically operated.

Depression of the pedal 10 actuates a 5-port valve 17 in the pneumatic system which causes the carriage 8 to make its return stroke, i.e. move to the front end of the top framework 5 as shown in FIGS. 1 and 2, whereupon the pedal may be released. Later the operator forwardly displaces the carriage 8, for a few inches. This action trips a roller 18 which actuates a 3-port valve 19 to make the necessary pneumatic connections and effect the rest of the forward stroke of the carriage 8 under power. The next return stroke of the carriage 8 is effected once again by depression of the pedal 10 as described above, and so on.

The carriage 8 comprises a C-section frame member 20 having an overlay 21 of foamed polymeric material held in position at the flanges by self-tapping screws 22 and metal strips 23. The flanges 9 also mount a plurality of roller guides 15 by means of bolts 25 and nuts 26, 27. Each roller guide 15 comprises a pair of ball races 28 separated by a spacer member 29, and is free to run along one of the tubular rails 7, themselves fastened to the top framework 5 by means of bolts 30 and nuts 31. The top framework 5 incorporates two cross-bars 32 which act as stops for the carriage 8, limiting its travel by interception as shown at 33. The overlay 21 has a grip-faced finish which ensures that sheets firmly deposited thereon and draped thereover will retain that position by friction, even against sizeable stresses, such as the horizontal component of the weight of a sheet depending therefrom or being drawn thereafter. The tabletop 6 serves to support the sheet additionally to the support given by the carriage 8 and comes into play when the carriage 8 is making or has made its forward stroke and before it again comes back to the position shown in FIGS. 1 and 2.

However, simpler forms of carriage may be used, and in particular the carriage may comprise a reversibly movable conveyor belt with appropriate sheet-retaining surface characteristics.

The drive machinery (FIGS. 5 and 6) comprises a compressed air-operated pneumatic ram 34 of 1¼ inches (32mm) bore and 12 inches (305mm) stroke, a pulley block 35 driven by the ram 34, four fixed pulleys 36*a–d* and a ¾ inch (19mm) × 1 mm nylon drive belt 24 anchored at its ends 37 and 38 to the pulley block 35, and attached to the underside of the carriage 8 at point 39 or thereabouts. This machinery is mounted as a unit in the top framework 5. The pneumatic circuit, including the 3-port valve 19 and the 5-port valve 17, is conventional, and is designed to ensure that the piston is exposed to compressed air, from one side or the other, in all states of the circuit. This gives a positive control of the movements of the carriage 8 and prevents unwanted or random movement thereof.

Figure 5:
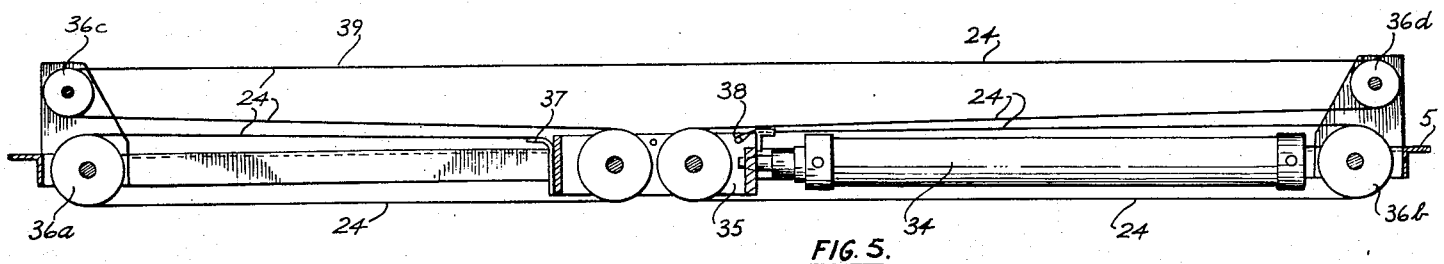
FIG. 5 is a side elevation of the drive machinery for the carriage of FIG. 4.
Figure 6:
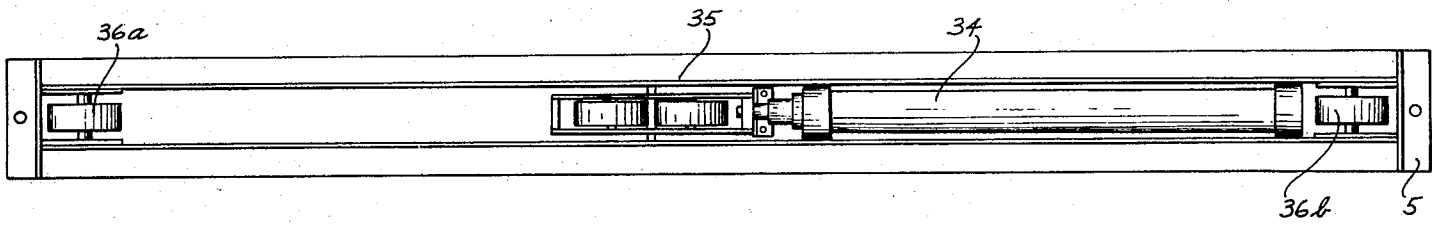
FIG. 6 is a plan view of the drive machinery of FIG. 5.

Inspection of FIG. 5 will show that the drive machinery acts as a block and tackle in reverse, and that the 12 inches (305mm) stroke of the ram 34 gives a 12 inches (305mm) displacement of the pulley block 35 and results in a 36 inches (915mm) displacement of the carriage 8, i.e. the ram displacement is magnified by a factor of three. Every displacement of the carriage 8 is thus three times greater than and opposite in direction to the corresponding causative displacement of the pulley block 35 and the ram 34.

Figure 3:
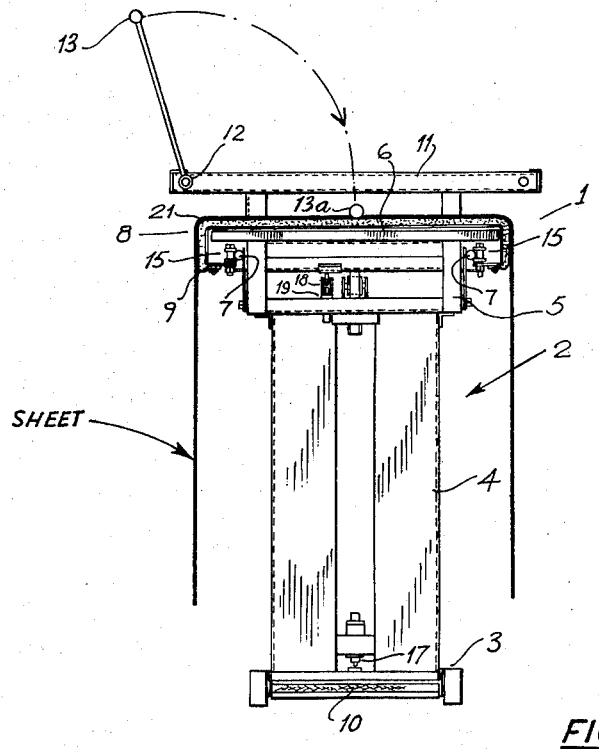
FIG. 3 is a front end elevation of the apparatus of FIG. 1.

In carrying out the method according to the invention, the single operator stands at the pedal (10) end of the apparatus, facing in the direction of view of FIG. 3, with a laundered but non-folded sheet between operator and apparatus. At this stage the sheet may be partly or wholly on the floor, and the carriage 8 is in its normal position of rest as shown in FIGS. 1 and 2, i.e., next to the operator, or if not, is brought into said position by the operator by once depressing and releasing the pedal 10, thus effecting the return stroke of the carriage.

The operator first locates and grasps the approximate mid-portion of one edge of the sheet (which ipso facto becomes the leading edge as that term is used herein) and drapes said portion across the carriage 8, to which said portion adheres by friction. The side edge portions of the sheet are allowed to drape on either side of the carriage 8, but preferably clear of the floor.

The operator then pushes the carriage 8 forward a small distance (some 3 or 4 inches). This frees the cam lever 18, opening the valve 17, and thus brings the pneumatic drive machinery into play, causing the carriage 8 to move to the opposite end of its track, i.e., make its forward stroke. In doing this, the carriage 8 trails the remainder of the sheet behind it over the now exposed tabletop 6. Meanwhile the operator bunches or shirrs the remainder of the sheet upon the tabletop 6 in the wake of the carriage 8, so as to locate and grasp the approximate mid-portion of the trailing edge of the sheet.

The operator now depresses (and releases) the pedal 10 again, causing the carriage 8 to return to the FIGS. 1–2 or resting position, drapes the trailing edge across the carriage 8 in register with the previously draped leading edge, and pushes the carriage 8 away a short distance, causing the carriage 8 to move forward under power once more. The operator locates and grasps the approximate mid-portion of the resulting loop, and repeats the above procedure, treating the loop as a trailing edge for the purpose. Further repetition of this sequence of operations results in the sheet acquiring a complete set of primary or longitudinal folds, and being draped neatly in toto across the carriage 8. Three repetitions can be regarded as a practical maximum, since then the primary folded sheet will contain $2^4$ or 16 sheet thicknesses.

The operator now swings the rod 13 (FIG. 3) into the position 13*a* and manually sweeps the right hand drape of the sheet over the rod 13 to produce the first cross-fold. The operator then swings the rod 13 back to its upper position, bringing the sheet with it, and centres the cross-fold by matching the hanging ends of the sheet if necessary. Finally the operator slides the once cross-folded sheet off the rod 13 and completes the cross-folding manually in the conventional way.

It will be appreciated that the apparatus of the invention can be powered manually or mechanically or is a sequence selected from various combinations of manual and mechanical operation. In embodiments in which the return stroke of the carriage 8 is manually powered, the operator can effect said return stroke by imparting a moderately sharp tug to the sheet, the leading edge of which is draped across the carriage 8. As primary folding proceeds, the need for carriage movement diminishes, and the final primary fold or folds can very often be made without the necessity of displacing the carriage 8.

It should also be understood that the fact that the width of the retaining carriage is substantially less than the width of a sheet to be folded is an important feature of the invention. Thus the operator can drape the mid-section of the leading or trailing edge of the sheet across said carriage by arm extension only, and is not obliged to walk left and right in doing so. The side portions of said sheet edges fall into a draped attitude on each side of the carriage under gravity, and do not have to be handled at all during primary folding.

It has been ascertained in tests on a prototype machine that a single operator, using the method and apparatus of this invention, can fold sheets at a substantially greater rate than two operators working in the conventional manual way.

I claim:

1. A one-operator method for folding a sheet having a pair of opposite edges, identified as the leading edge and the trailing edge, which method comprises a. placing the leading edge of said sheet over a retaining carriage which is generally horizontally movable away from and towards an operator's station;

b. then moving the retaining carriage and leading edge of the sheet away from the operator's station when the operator locates and holds a trailing portion of the sheet spaced from said leading edge;

c. moving the retaining carriage back to the operator's station; and:

d. placing the trailing edge over the leading edge of the sheet upon the retaining carriage thereby forming a folded edge generally parallel to and spaced from the then adjacent leading and trailing edges.

2. The method of claim 1 further including the repeating of steps (b) and (d) n times according to need, treating each successive resulting creased or folded edge as the trailing edge for that purpose, where n is one or integer not exceeding three.

3. A method as claimed in claim 1, wherein the retaining carriage in its movement is powered by the bodily effort of the operator.

4. A method as claimed in claim 1, wherein the operator applies power, to move the retaining carriage, from an external power source by means of switches, levers, pedals or the like.

5. A method as claimed in claim 1, additionally including the step of placing a rod member across the primary folded sheet, the product of step e), cross-folding one half of said sheet upon the other half over said rod, removing the rod and sheet from the retaining carriage, and withdrawing the rod and sheet from their mutual engagement.

6. Apparatus for folding a sheet or the like having a given length and width, said apparatus comprising: a support, a carriage mounted on said support for rectilinear movement back and forth in a plane which extends generally horizontally and between an operator sheet-feeding station and a remote point substantially removed therefrom, said carriage having a width so much less than the width of said sheet that the sheet will drape downwardly a substantial distance from opposite sides of the carriage when the sheet is centered thereon, said carriage when moved to said operator feeding station being in a position where the operator can place the leading edge of the sheet upon a portion of the carriage, means on said carriage for holding the sheet placed thereon, said carriage when thereafter moved to said remote point being spaced from said operator feeding station to a degree where the operator can grasp the trailing edge portion of the sheet without moving therefrom and place the same in alignment with the leading edge portion thereof when the carriage is returned to the operator feeding station to form a fold in the sheet extending at right angles to the direction of movement of said carriage, and cross-folding means for creating a fold in said folded sheet on the carriage in a direction parallel to said direction of carriage movement.

7. Apparatus as claimed in claim 6, wherein the sheet material retaining carriage comprises a platform having a surface which retains the sheet material placed thereupon.

8. Apparatus as claimed in claim 6, wherein the sheet material retaining carriage is mounted on the support by means of a pair of rails and a cooperating set of rollers.

9. Apparatus as claimed in claim 6, wherein the sheet material retaining carriage is movable by means of a drive belt attached thereto, or integral therewith.

10. Apparatus as claimed in claim 9, wherein the sheet material retaining carriage comprises a reversibly movable conveyor belt.

11. Apparatus as claimed in claim 9, wherein the drive belt passes around a set of cooperating rollers mounted on the support.

12. Apparatus as claimed in claim 11, wherein the set of rollers includes a subset mounted in a roller block which block is displaceable with respect to the support, whereby displacement of said block causes the sheet material retaining carriage to move.

13. Apparatus as claimed in claim 12, wherein a pneumatic ram, a pulley block and a drive belt are operatively connected to the sheet material retaining carriage at a mechanical disadvantage, whereby in use every displacement of the sheet material retaining carriage is a constant multiple of the corresponding stroke of the pneumatic ram or the corresponding displacement of the roller block.

14. Apparatus as claimed in claim 6, wherein the sheet material retaining carriage is powered by fluidic means.

15. Apparatus as claimed in claim 6 additionally comprising a straight rod member adapted to be placed upon the platform parallel to the axis of travel of the platform, and to be lifted off and to one side of the platform thereafter.

16. Apparatus as claimed in claim 15, wherein the rod member is pivotally mounted upon the support, the pivotal axis being remote from but parallel to the rod itself.

17. The apparatus of claim 6, wherein said cross-folding means is a rod extending parallel to the direction of movement of the carriage and moveable between a position spaced from the carriage where it does not interfere with the placement of a sheet thereon to a position adjacent thereto where a sheet thereon can be cross-folded thereover.

18. The apparatus of claim 17, wherein there is provided means for supporting rod for bodily movement between a position located to one side of said carriage and a position where it is contiguous to said carriage.

19. The apparatus of claim 6, wherein there is provided foot pedal means at the operator's station, carriage moving means responsive to operation of said foot pedal means for effecting movement between said operator sheet-feeding station and said remote point.

20. The apparatus of claim 19, wherein said foot pedal means operates said carriage moving means only to return said carriage from said remote point to said operator's sheet-feeding station, said carriage being manually movable a short distance away from operator sheet-feeding station, and limit switch means responsive to movement of said carriage a short distance from said operator sheet-feeding station for operating said carriage moving means to move said carriage to said remote point.

* * * * *